US006260400B1

(12) United States Patent
Nishigohri et al.

(10) Patent No.: US 6,260,400 B1
(45) Date of Patent: Jul. 17, 2001

(54) FULL ENCLOSED FORGING APPARATUS

(75) Inventors: Shigeru Nishigohri; Tadashi Okumura, both of Shiga; Fujio Sunami, Sakura, all of (JP)

(73) Assignees: Gohysu Corporation, Koga-gun; Yamanaka Eng. Co., Ltd., Osaka, both of (JP)

( * ) Notice: Subject to any disclaimer, the term of this patent is extended or adjusted under 35 U.S.C. 154(b) by 0 days.

(21) Appl. No.: 09/457,297

(22) Filed: Dec. 9, 1999

(30) Foreign Application Priority Data

Dec. 14, 1998 (JP) ..... 10-354236
May 10, 1999 (JP) ..... 11-128711

(51) Int. Cl.[7] ..... B21J 9/18
(52) U.S. Cl. ..... 72/355.6; 72/354.8
(58) Field of Search ..... 72/354.8, 355.6

(56) References Cited

U.S. PATENT DOCUMENTS 4,590,782 * 5/1986 Leykamm et al. ..... 72/354.8
4,653,310 * 3/1987 Urata et al. ..... 72/355.6

FOREIGN PATENT DOCUMENTS 63-220941 * 9/1988 (JP) ..... 72/355.6
6-91339 * 4/1994 (JP) ..... 72/355.6

* cited by examiner

*Primary Examiner*—Lowell A. Larson
(74) *Attorney, Agent, or Firm*—Armstrong, Westerman, Hattori, McCleland & Naughton, LLP

(57) ABSTRACT

A full enclosed forging apparatus comprising a construction in which an upper die holder and a lower die holder are respectively disposed as to face a press machine, at least one of the upper die holder and the lower die holder is composed of a holder main body holding a die and a holder base attached to the press machine, and the holder main body is attached to the holder base through plural spring mechanisms with an aperture as an interference of the spring mechanisms as that an upper punch proceeds into the upper die and a lower punch proceeds into the lower die after the upper die held by the upper die holder and the lower die held by the lower die holder contact.

3 Claims, 13 Drawing Sheets

FULL ENCLOSED FORGING APPARATUS

BACKGROUND OF THE INVENTION

1. Field of the Invention

This invention relates to a full enclosed forging apparatus having durability for a compact and simple construction in which full enclosed forging (double-action forging) is simply and economically conducted with a small single-action press machine.

2. Description of the Related Art

Conventionally, full enclosed forging (double-action forging) is conducted in case that a material is formed into a complicated configuration with a press machine in one production process.

This full enclosed forging can perform a first movement and a following second movement in one production process with ① using a double-action press machine, or ② auxiliary mechanisms such as a slider mechanism, a link mechanism, etc. attached to a single-action forging machine.

However, there is a problem that the above double-action press machine of ① has an oil-hydraulic apparatus and its control mechanism having complicated construction, and equipment cost rises thereby. And, the method of ②, in which the auxiliary mechanisms are attached to the single-action press machine, can not be applied to a small press machine because large space for installation of the auxiliary mechanism is necessary, equipment cost increases for necessity of new installation of a large press machine, and the auxiliary mechanism also has problems in durability.

To solve the problems above, it is therefore an object of the present invention to provide a full enclosed forging apparatus having durability for a compact and simple construction in which full enclosed forging can be conducted simply and economically with a small single-action press machine.

BRIEF DESCRIPTION OF THE DRAWINGS

The present invention will be described with reference to the accompanying drawings in which.

DESCRIPTION OF THE PREFERRED EMBODIMENTS

Preferred embodiments of the present invention will now be described with reference to the accompanying drawings.

Figure 1:
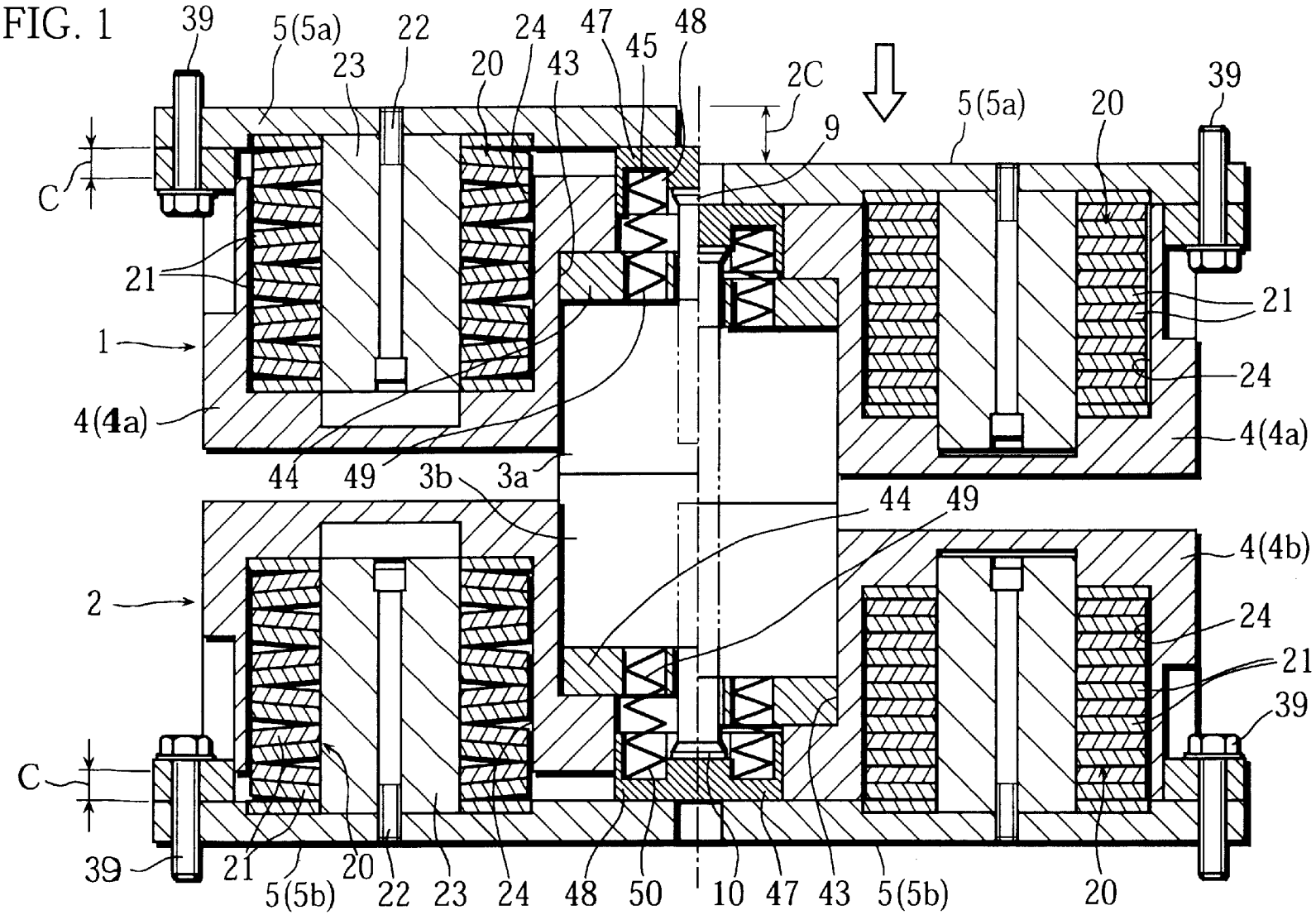
FIG. 1 is a cross-sectional front view showing a first preferred embodiment of a full enclosed forging apparatus of the present invention of which left-half is showing an upper die and a lower die contact each other, and right-half is showing the upper die and the lower die are pressed after the contact.
Figure 2:
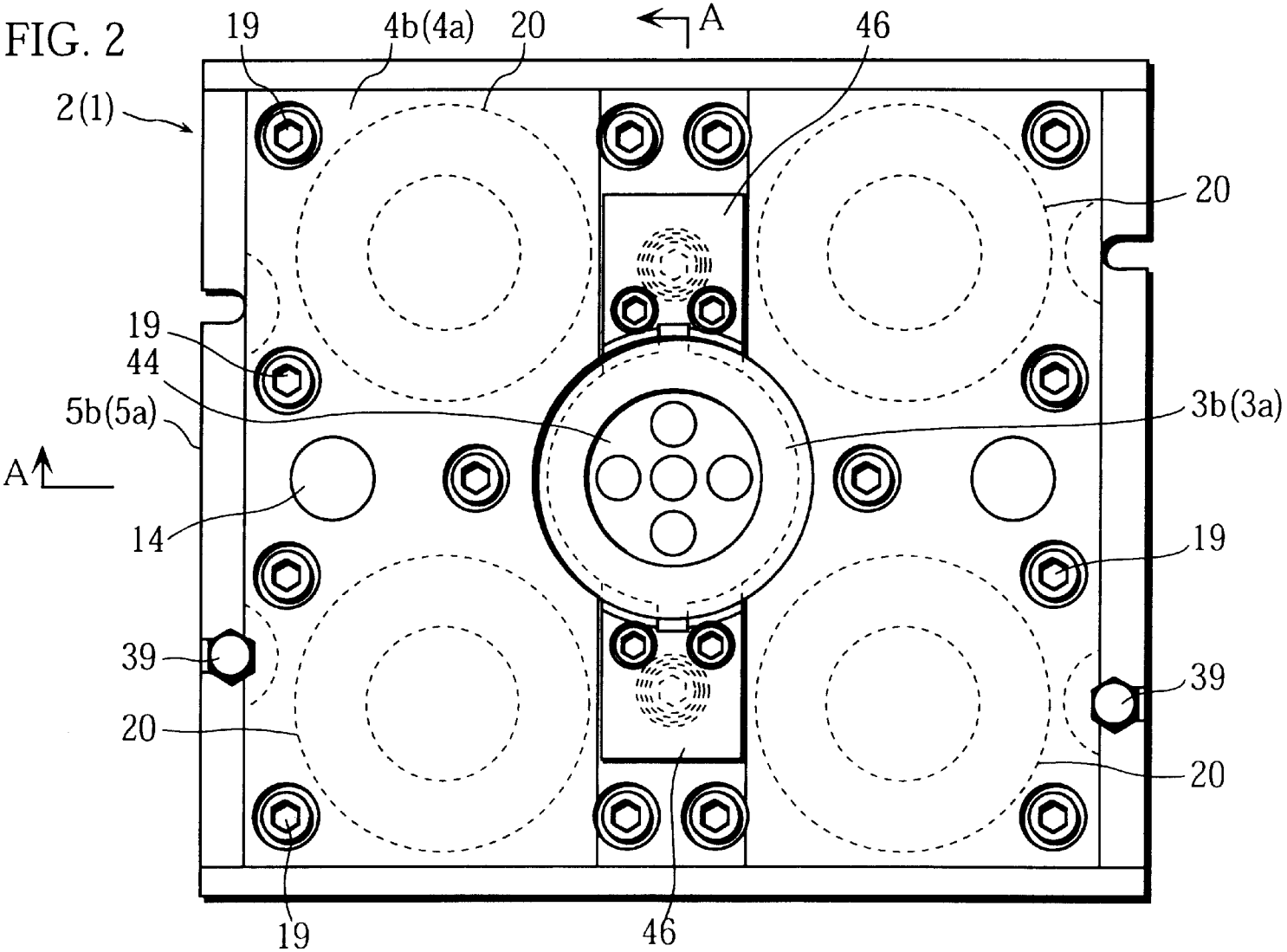
FIG. 2 is a plane view showing a lower die holder (an upper die holder)
Figure 3:
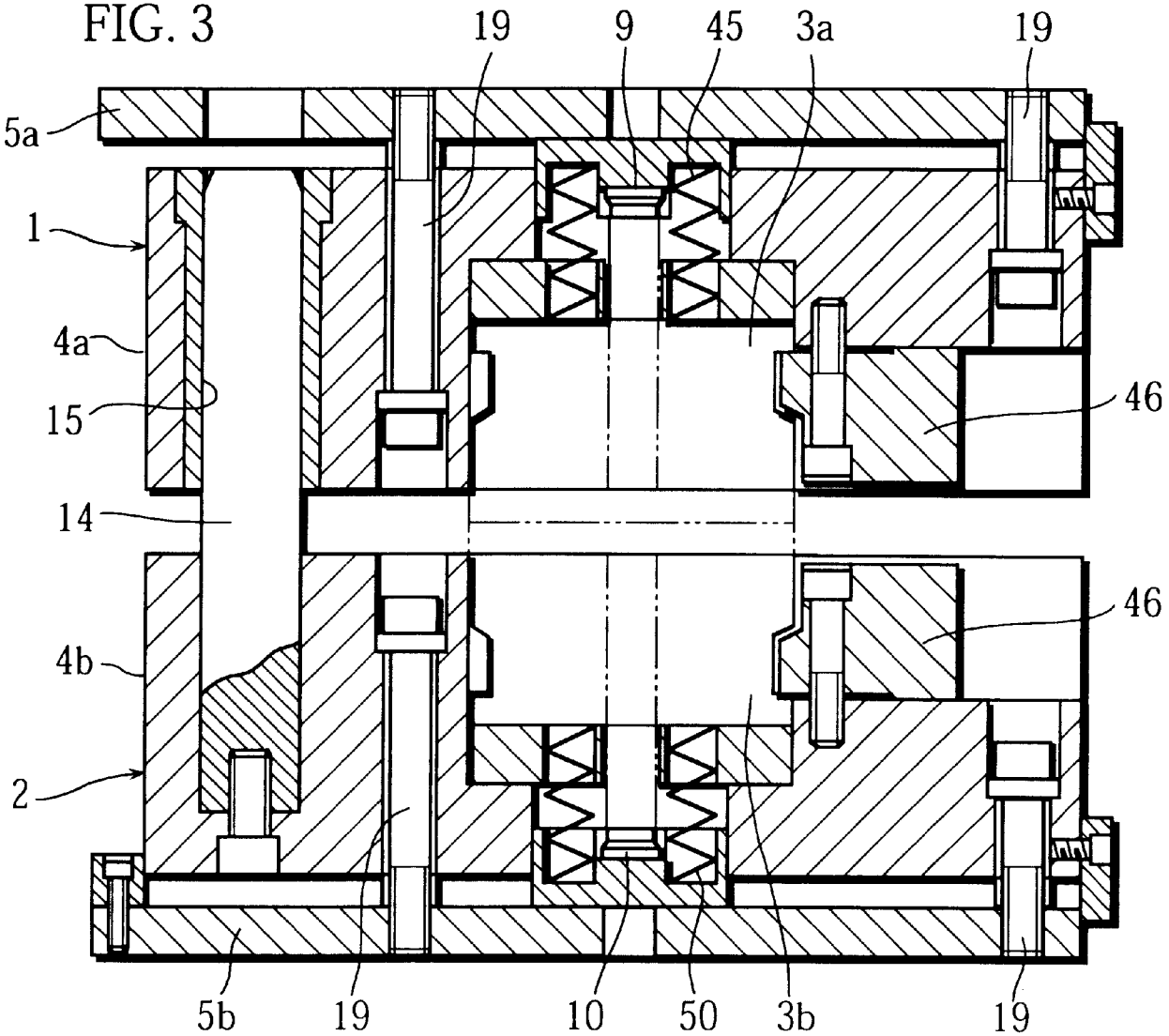
FIG. 3 is a cross-sectional view of FIG. 2 at A—A line.

FIG. 1 through FIG. 3 show a preferred embodiment of a full enclosed forging apparatus of the present invention (a first preferred embodiment). In this full enclosed forging apparatus, provided with an upper die holder 1 directly attached to an upper attachment stage or a ram of a press machine and a lower die holder 2 attached to a lower attachment stage, the upper die holder 1 and the lower die holder 2 are respectively arranged upper and lower in the press machine as to face each other. Positioning of the upper die holder 1 and the lower die holder 2 is conducted by inserting a guiding rod 14, protruding from the lower die holder 2, to a guiding rod insertion hole 15 formed in the upper die holder 1 in working of the press machine.

Main portion of the upper die holder 1 is composed of an upper holder base 5*a* fixed to an upper attachment stage or a ram of the press machine with bolts 39, an upper holder main body 4*a*, and spring mechanisms 20 between the upper holder base 5*a* and the upper holder main body 4*a*.

In this case, the upper holder main body 4*a* is attached with bolts 19 as to move vertically for a predetermined distance of an aperture C, an upper die 3*a* is placed in a die fitting portion 43 formed on a central part of the upper holder main body 4*a* with a spacer 44, and an upper punch 9 is disposed on a center of the upper die 3*a* with a push up spring 45. And, the upper die 3*a*, placed in the die fitting portion 43 with the spacer 44, is fixed to the upper holder main body 4*a* through a die attachment member 46.

And, a spring insertion hole 48 is formed along a peripheral portion of a flange 47 formed on a base end side of the upper punch 9, the push-up spring 45 is arranged in the spring insertion hole 48 as to contact an upper face of the upper die 3*a* through another spring insertion hole 49 formed on the spacer 44 of the upper die 3*a*, and the upper punch 9 is pushed upward thereby.

And, the spring mechanism 20 between the upper holder base 5*a* and the upper holder main body 4*a*, not restricted to a specific number, is disposed on four positions as to be symmetric with respect to the upper die 3*a* fixed to the upper holder main body 4*a* in the present embodiment. And, the spring mechanism 20 is composed of concentrically laminated plural belleville springs 21 fitted to a belleville spring holding body 23 fixed to the upper holder base 5*a* with a bolt 22, placed in a spring mechanism insertion hole 24 formed in the upper holder main body 4*a*, and pushing the upper holder main body 4*a* downward.

On the other hand, the lower die holder 2 basically similar construction to that of the upper die holder 1. That is to say, a main part of the lower die holder 1 is composed of a lower holder base 5*b* fixed to a lower attachment stage (bolster) of the press machine with bolts 39, a lower holder main body 4*b*, and spring mechanisms 20 between the lower holder base 5*b* and the lower holder main body 4*b*.

In this case, the lower holder main body 4*b* is attached with bolts 19 as to move vertically for a predetermined distance of an aperture C, an upper die 3*b* is placed in a die fitting portion 43 formed on a central part of the lower holder main body 4*b* with a spacer 44, and an lower punch 10 is disposed on a center of the lower die 3*b* with a push-down spring 50. And, the lower die 3*b*, placed in the die fitting portion 43 with the spacer 44, is fixed to the lower holder main body 4*b* through a die attachment member 46.

And, a spring insertion hole 48 is formed along a peripheral portion of a flange 47 formed on a base end side of the lower punch 10, the push-down spring 50 is arranged in the spring insertion hole 48 as to contact a lower face of the lower die 3*b* through another spring insertion hole 49 formed on the spacer 44 of the lower die 3*b*, and the lower punch 10 is pushed downward thereby.

And, the spring mechanism 20 between the lower holder base 5*b* and the lower holder main body 4*b*, not restricted to a specific number, is disposed on four positions as to be symmetric with respect to the lower die 3*b* fixed to the lower holder main body 4*b* in the present embodiment. And, the spring mechanism 20 is composed of concentrically laminated plural belleville springs 21 fitted to a belleville spring holding body 23 fixed to the lower holder base 5*b* with a bolt 22, placed in a spring mechanism insertion hole 24 formed in the lower holder main body 4*b*, and pushing the lower holder main body 4*b* upward.

Next, working of the full enclosed forging apparatus of the present invention will be described.

First, the upper die holder 1 and the lower die holder 2 are attached to the press machine on an upper side and a lower side with the bolts 39 as to face each other. In this case, the upper die 3*a* and the upper punch 9 of a predetermined configuration are attached to the upper die holder 1, and the lower die 3*b* and the lower punch 10 of a predetermined configuration are attached to the lower die holder 2. And, a material to be formed is placed on the lower die 3*b*.

After then, for example, the die holder 1 is descended with the upper die 3*a* by working of the press machine, the upper die 3*a* attached to the upper die holder 1 and the lower die 3*b* attached to the lower die holder 2 contact each other, the material placed on the lower die 3*b* is held between the upper die 3*a* and the lower die 3*b* as to conduct predetermined forging (left-half of FIG. 1 (first movement)).

Next, continuing from the first movement (in which the upper die 3*a* and the lower die 3*b* contact, and the material is held between the upper die 3*a* and the lower die 3*b*), the upper holder main body 4*a* and the lower holder main body 4*b* are pressed through the upper die 3*a* and the lower die 3*b* touching each other by descending the upper die holder 1 with the upper die 3*a*, the upper holder main body 4*a* relatively moves upward to the upper holder base 5*a* and the lower holder main body 4*b* relatively moves downward to the lower holder base 5*b* resisting against the pushing power of the belleville springs 21 of the upper and lower spring mechanisms 20 as to narrow the aperture C between the upper holder base 5*a* and the upper holder main body 4*a* of the upper die holder 1, and the aperture C between the lower holder base 5*b* and the lower holder main body 4*b* of the lower die holder 2.

According to the above working, the upper punch 9 attached to the upper die holder 1 and the lower punch 10 attached to the lower die holder 2 proceed respectively into the upper die 3*a* and the lower die 3*b*, the material held between the upper die 3*a* and the lower die 3*b* is forged into a predetermined configuration (right-half of FIG. 1 (second movement)).

The maximum descending distance of the upper die holder 1 is 2 C that the aperture C between the upper holder base 5*a* and the upper holder main body 4*a* of the upper die holder 1, and the aperture C between the lower holder base 5*b* and the lower holder main body 4*b* of the lower die holder 2 vanish after the upper die 3*a* and the lower die 3*b* contact the material.

After the forging, the upper die holder 1 is ascended with the upper die 3*a*, the aperture C between the upper holder base 5*a* and the upper holder main body 4*a* of the upper die holder 1, and the aperture C between the lower holder base 5*b* and the lower holder main body 4*b* of the lower die holder 2 are enlarged by pushing power of the belleville springs 21 of the upper and lower spring mechanisms 20 in a state that the upper die 3*a* contacts the lower die 3*b* and the formed product (the material forged into the predetermined configuration) is held between the upper die 3*a* and the lower die 3*b*, and, the upper holder main body 4*a* relatively moves downward to the upper holder base 5*a* and the lower holder main body 4*b* relatively moves upward to the lower holder base 5*b*.

And, the upper die holder 1 is ascended with the upper die 3*a* further, the contact of the upper die 3*a* and the lower die 3*b* is released, the upper die 3*a* and the lower die 3*b* become open, and the formed product can be taken out of the die. At the same time, the upper punch 9 and the lower punch 10 respectively part from the formed product by pushing power of the push-up spring 45 and the push-down spring 50, and return to initial positions.

Although the upper and lower spring mechanisms 20 and the upper and lower punches 9 and 10 are disposed on both of the upper die holder 1 and the lower die holder 2 in the present embodiment, these mechanisms may be disposed on only one die holder, and the other die holder may be provided with only the die depending on configurations of the product.

Figure 4:
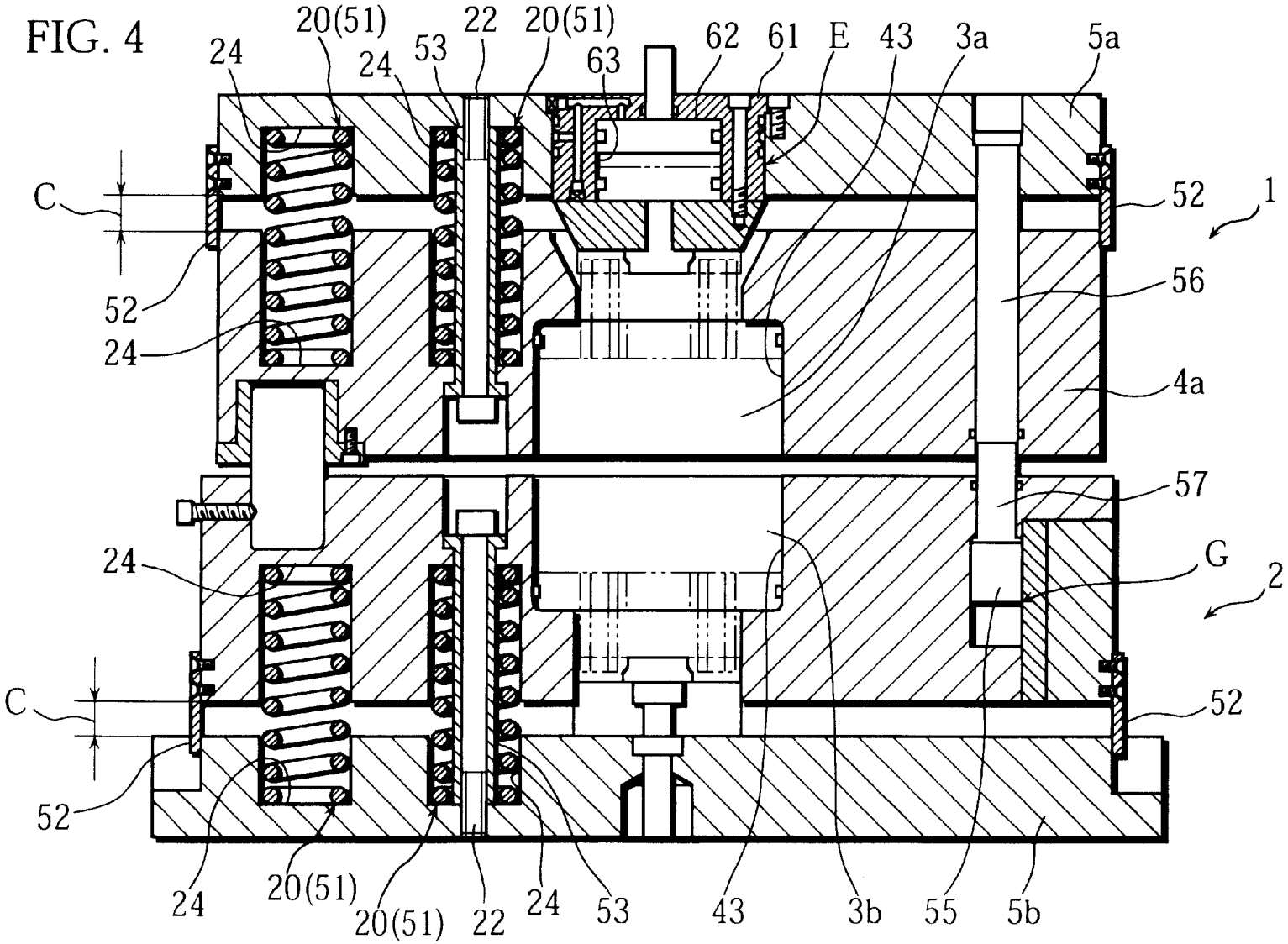
FIG. 4 is a cross-sectional front view showing a lower die holder and an upper die holder before forging of a second preferred embodiment of the present invention.
Figure 5:
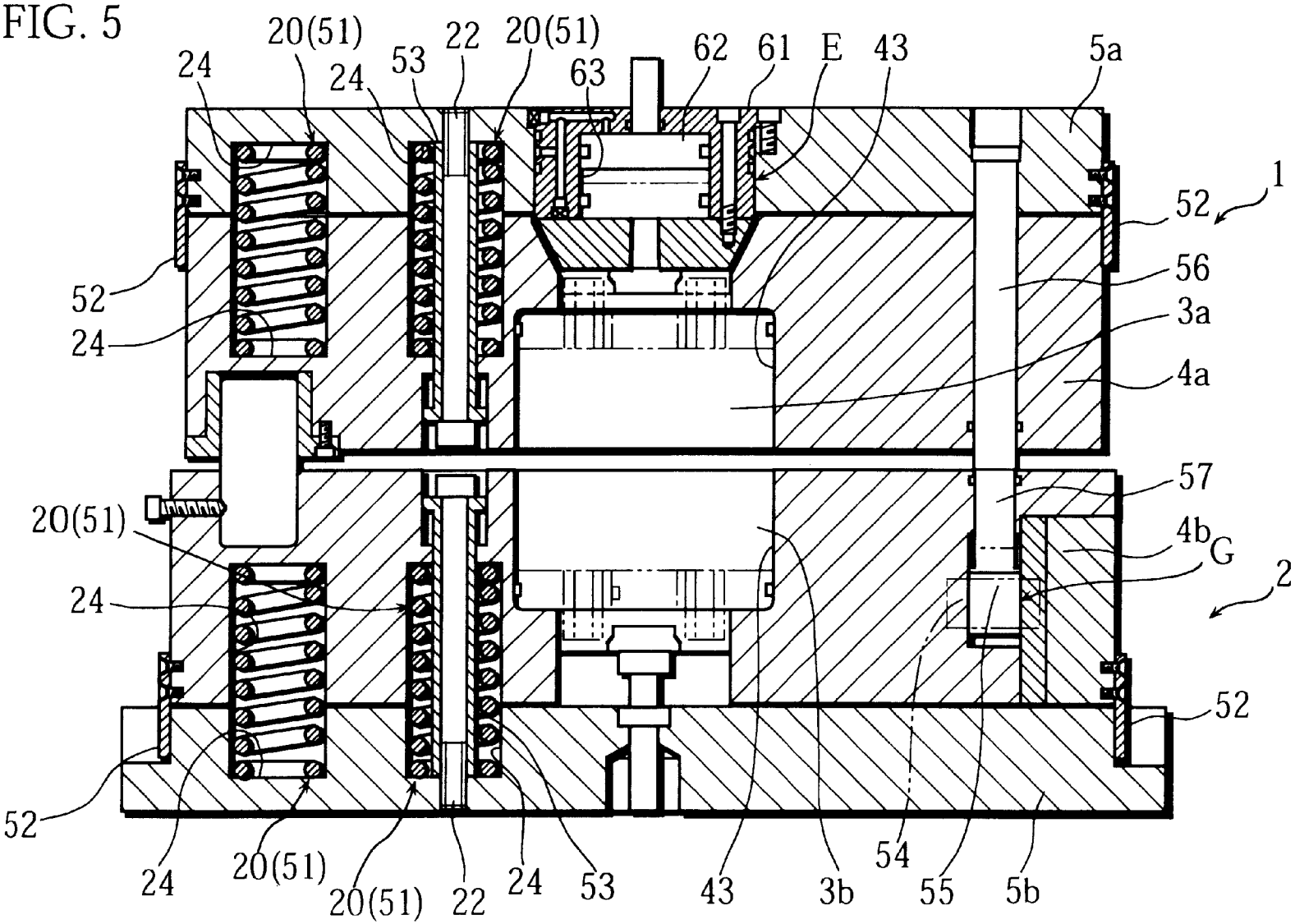
FIG. 5 is a cross-sectional front view showing the lower die holder and the upper die holder in forging.

Next, FIG. 4 and FIG. 5 show a second preferred embodiment of the present invention. This embodiment, in which each of the plural spring mechanisms 20 is composed of a compression spring 51 disposed in an upper die holder 1 and a lower die holder 2 attached to a press machine, is provided with a synchronization mechanism G and a forged product release mechanism E.

In this case, a die fitting portion 43 is formed on a central portion of a lower face of an upper holder main body 4*a* of the upper holder 1, and plural insertion holes 24 are formed on approximately whole upper face of the upper holder main body 4*a* of the upper holder 1 corresponding to surrounding area of the die fitting portion 43.

Number of the insertion holes 24, determined corresponding to load on the upper holder main body 4*a* in forging and spring constant of the compression spring 51, is set as to receive the load on the upper holder main body 4*a* uniformly.

And, insertion holes 24 are also formed on a lower face of an upper holder base 5*a* disposed above the upper holder main body 4*a* as to correspond to the insertion holes 24 formed on the upper holder main body 4*a*. Depth of the upper and lower insertion holes 24 is set as to hold the compression spring 51.

The vertically laminated upper holder base 5*a* and the upper holder main body 4*a* are positioned by sliding guiding plates 52, attached to left and right end faces of the upper holder base 5*a*, on left and right end faces of the upper holder main body 4*a*, and by bolts 22 going through the compression springs 51 inserted to the insertion holes 24 of the upper holder main body 4*a* and the upper holder base 5*a* from the upper holder main body 4*a* side and screwed to the upper holder base 5*a*.

In the upper die holder 1, corresponding to the load working on the upper holder main body 4*a* in forging, the compression springs 51 are inserted to all of or some of the plural pairs of the upper and lower insertion holes 24.

And, the bolt 22 can be omitted on a position where a (later described) synchronization mechanism G, which synchronizes the upper die holder 1 and the lower die holder 2, is disposed. And, the bolt 22 may be covered by a sleeve 53 for protection of the bolt 22 and easy positioning of the upper holder base 5*a* and the upper holder main body 4*a*.

In this case, the upper holder main body 4*a* is attached with an aperture C as to be movable vertically for a predetermined distance to the upper holder base 5*a*.

On the other hand, the lower die holder 2 has a basically similar construction to that of the upper die holder 1. That is to say, a die fitting portion 43 is formed on an lower holder main body 4*b*, and plural insertion holes 24 are formed on approximately whole upper face of the lower holder main body 4*b* corresponding to surrounding area of the die fitting portion 43.

Number of the insertion holes 24, determined corresponding to load on the lower holder main body 4*b* and spring constant of the compression spring 51 in forging, is set as to receive the load on the lower holder main body 4*b* uniformly.

And, insertion holes 24 are also formed on an upper face of an lower holder base 5*b* disposed below the lower holder main body 4*b* as to correspond to the insertion holes 24 formed on the lower holder main body 4*b*. Depth of the upper and lower insertion holes 24 is set as to hold the compression spring 51.

The lower holder base 5*b* and the lower holder main body 4*b* are positioned by sliding guiding plates 52, attached to left and right end faces of the lower holder main body 4*b*, on left and right end faces of the lower holder base 5*b*, and by bolts 22 going through the compression springs 51 inserted to the insertion holes 24 of the lower holder main body 4*b* and the lower holder base 5*b* from the lower holder main body 4*b* side and screwed to the lower holder base 5*b*.

In the lower die holder 1, corresponding to the load working on the lower holder main body 4*b* in forging, the compression springs 51 are inserted to all of or some of the plural pairs of the upper and lower insertion holes 24.

And, the bolt 22 can be omitted on a position where a (later described) synchronizing mechanism G, which synchronizes the upper die holder 1 and the lower die holder 2, is disposed. And, the bolt 22 may be covered by a sleeve 53 for protection of the bolt 22 and easy positioning of the upper holder base 5*a* and the upper holder main body 4*a*.

In this case, the lower holder main body 4*b* is attached with an aperture C as to be movable vertically for a predetermined distance to the lower holder base 5*b*.

Next, with reference to FIG. 4 through FIG. 7, the synchronization mechanism G, which synchronizes the descent of the lower holder main body 4*b* of the lower die holder 2 with the descent of the upper holder main body 4*a* of the upper die holder 1, is described.

The synchronization mechanism G is composed of a lever 55 supported by a shaft 54 in the lower holder main body 4*b* of the lower die holder 2 as to oscillate in a seesaw-like manner, a fixed rod 56 of which upper end is fixed to the upper holder base 5*a* and disposed as to go through the upper holder main body 4*a*, a sliding rod 57 facing a lower end face of the fixed rod 56 and touching an end side of the lever 55 inserted to the lower holder main body 4*b*, and a lever supporting piece 60, protruding upward from the lower holder base 5*b*, of which upper part is inserted to a hole 58 formed in the lower holder main body 4*b* as to slide, and having a cavity 59 formed on a side face to which the other end of the lever 55 fits to be stopped.

Figure 7A:
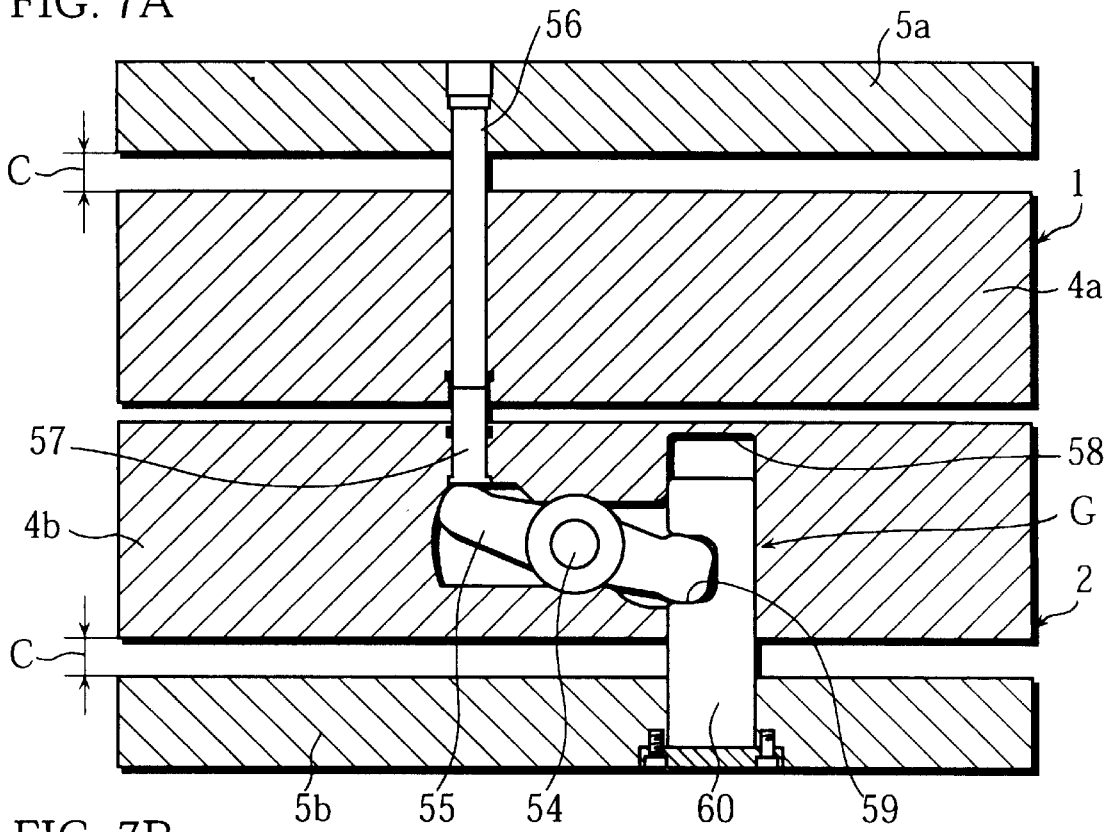
FIG. 7A is a cross-sectional front view showing a synchronization mechanism before forging.
Figure 7B:
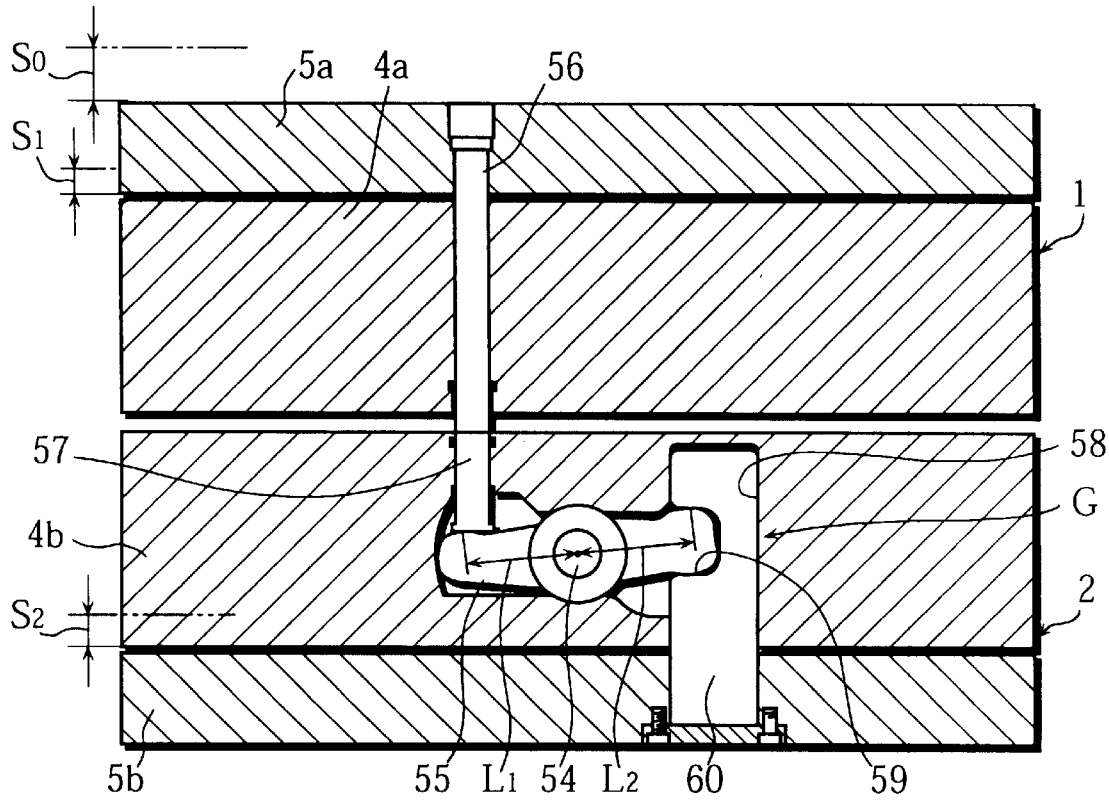
FIG. 7B is a cross-sectional front view showing the synchronization mechanism in forging.

In the synchronization mechanism G, as shown in FIGS. 7A and 7B, the upper holder main body 4*a* descends from the state shown in FIG. 7A to the state shown in FIG. 7B by working of a press machine through the upper holder base 5*a*, the lower end of the fixed rod 56 fixed to the upper holder base 5*a* contacts and pushes the sliding rod 57 down, and the lever 55 oscillates in a seesaw-like manner of which supporting point is the shaft 54 thereby because the other end of the lever 55 is fitting to the cavity 59 on the lever supporting piece 60 and restricted.

In this case, distance $L_1$ from the shaft 54 to a contact position of the lever 55 and the sliding rod 57 and distance $L_2$ from the shaft 54 to a fitting position of the lever 55 with the cavity 59 of the lever supporting piece 60 are set to be same. And, the other end of the lever 55 is fitted to the cavity 59 of the lever supporting piece 60 and restricted. For these conditions, the lower holder main body 4*b* is pushed down for descending amount $S_2$ which is ½ of descending amount $S_0$ of the upper holder base 5*a* to diminish an aperture C between the upper holder base 5*a* and the upper holder main body 4*a* and an aperture C between the lower holder base 5*b* and the lower holder main body 4*b* simultaneously for the same amount. That is to say, when the upper holder main body 4*a* descends for descending amount $S_1$, the lower holder main body 4*b* descends for the descending amount $S_2$ equal to the descending amount $S_1$ synchronized with the upper holder main body 4*a*.

For this, even in case that difference of forming ability between the upper die 3*a* and the lower die 3*b* in forging is caused by abrasion of the die 3, trouble in lubricant oil, etc., the upper die holder 1 and the lower die holder 2 is forced to move synchronously to form uniformly, and accuracy of the formed product is kept high.

Figure 6:
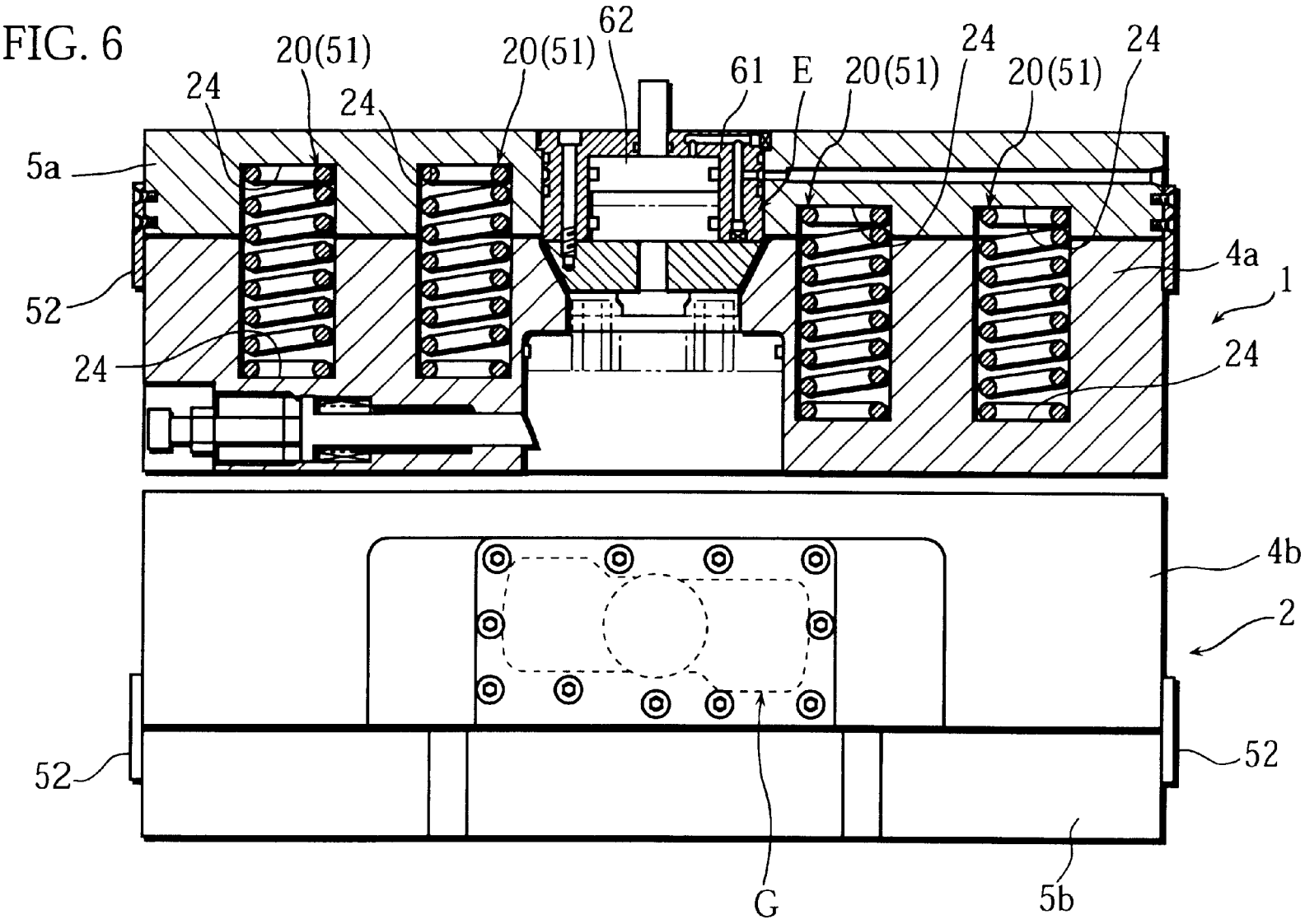
FIG. 6 is a cross-sectional side view of a principal portion showing the lower die holder and the upper die holder before forging.

Next, a forged product release mechanism E, which forces the forged product on the upper die 3*a* to part from the die for smooth automatic forging, is described with reference to FIG. 4 through FIG. 6.

The forged product release mechanism E has a construction in which a release mechanism main body 61 is embedded in the upper holder base 5*a* right above the upper die 3*a* and attached to the upper holder base 5*a* right above the upper die 3*a* with bolts, a piston 62 is inserted to a cylinder portion 63 formed in the release mechanism main body 61 as to push down lockout of the upper die 3*a*, and pressurized fluid (hydraulic oil, for example) is supplied into the cylinder portion 63.

In this case, the pressurized fluid is supplied simultaneously when the upper die holder 1 ascends from the bottom dead point, and the forged product in the upper die 3*a* is forcibly released.

And, instead of the supply of the pressurized fluid, a head side of the cylinder portion 63 may be tightly closed to contain gas which is compressed by the piston 62 when the upper holder base 5*a* is pushed down, and the piston 62 is pushed down by the pressure of the gas compressed in the ascension of the upper die holder 1 from the bottom dead point as to press down the lockout of the upper die 3*a*.

The synchronization mechanism G and the forged product release mechanism E, described in the second preferred embodiment, are also applicable to the first preferred embodiment described above and the third preferred embodiment described below.

Figure 8:
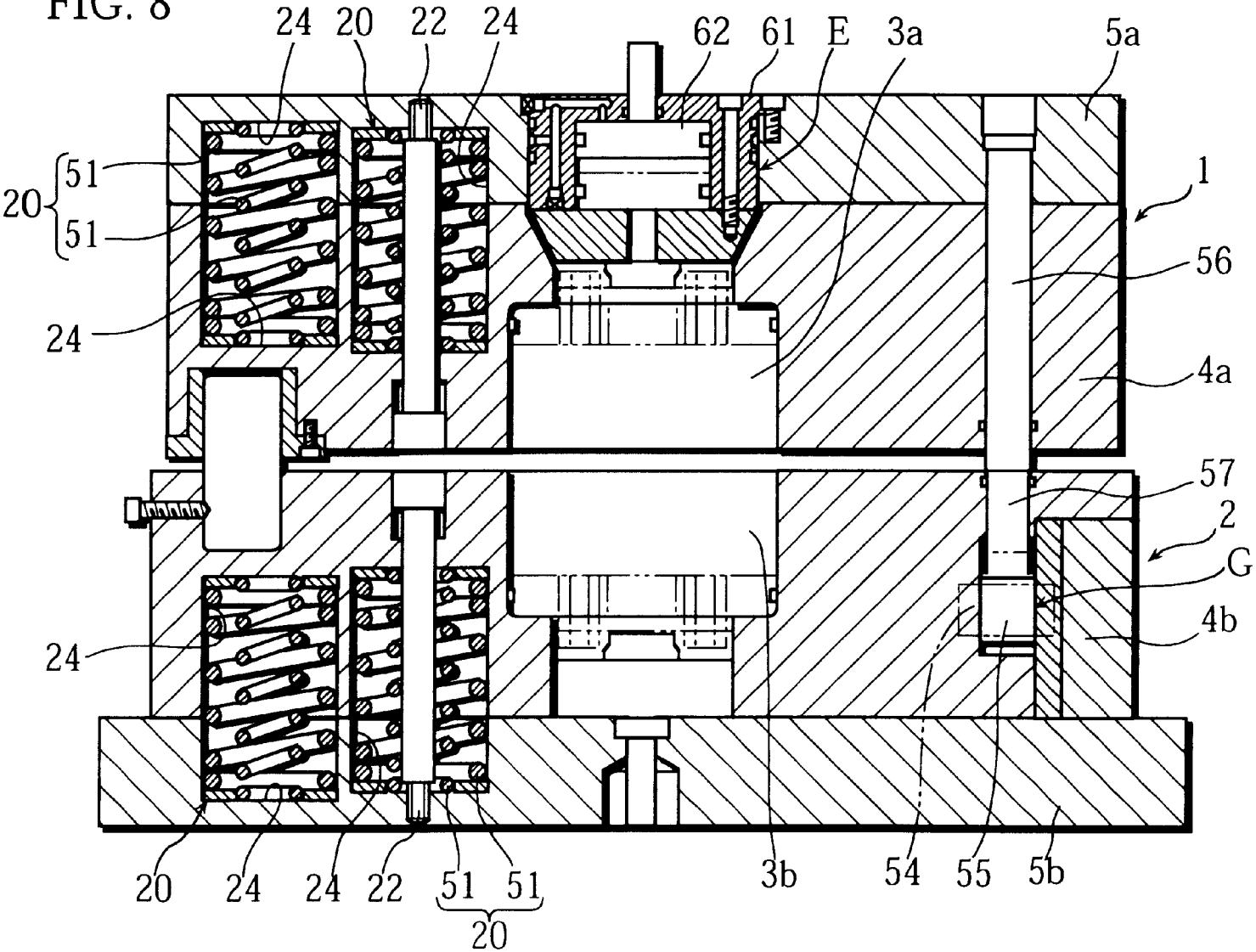
FIG. 8 is a cross-sectional front view showing a lower die holder and an upper die holder in forging of a third preferred embodiment of the present invention.

Next, FIG. 8 shows a third preferred embodiment of the present invention. In this full enclosed forging apparatus, the spring mechanisms 20 are constructed as that two compression springs having different diameter are concentrically inserted to the plural pairs of upper and lower insertion holes 24 formed in the upper holder base 5*a* and the upper holder main body 4*a*, and the plural pairs of upper and lower insertion holes 24 formed in the lower holder main body 4*b* and the lower holder base 5*b*. With this construction, elastic force of one unit of the spring mechanism 20 increases, and number of the spring mechanisms 20 and the insertion holes 24 can be reduced thereby. And, other constructions and working of the third preferred embodiment are similar to that of the full enclosed forging apparatus of the above-described second preferred embodiment.

Figure 9:
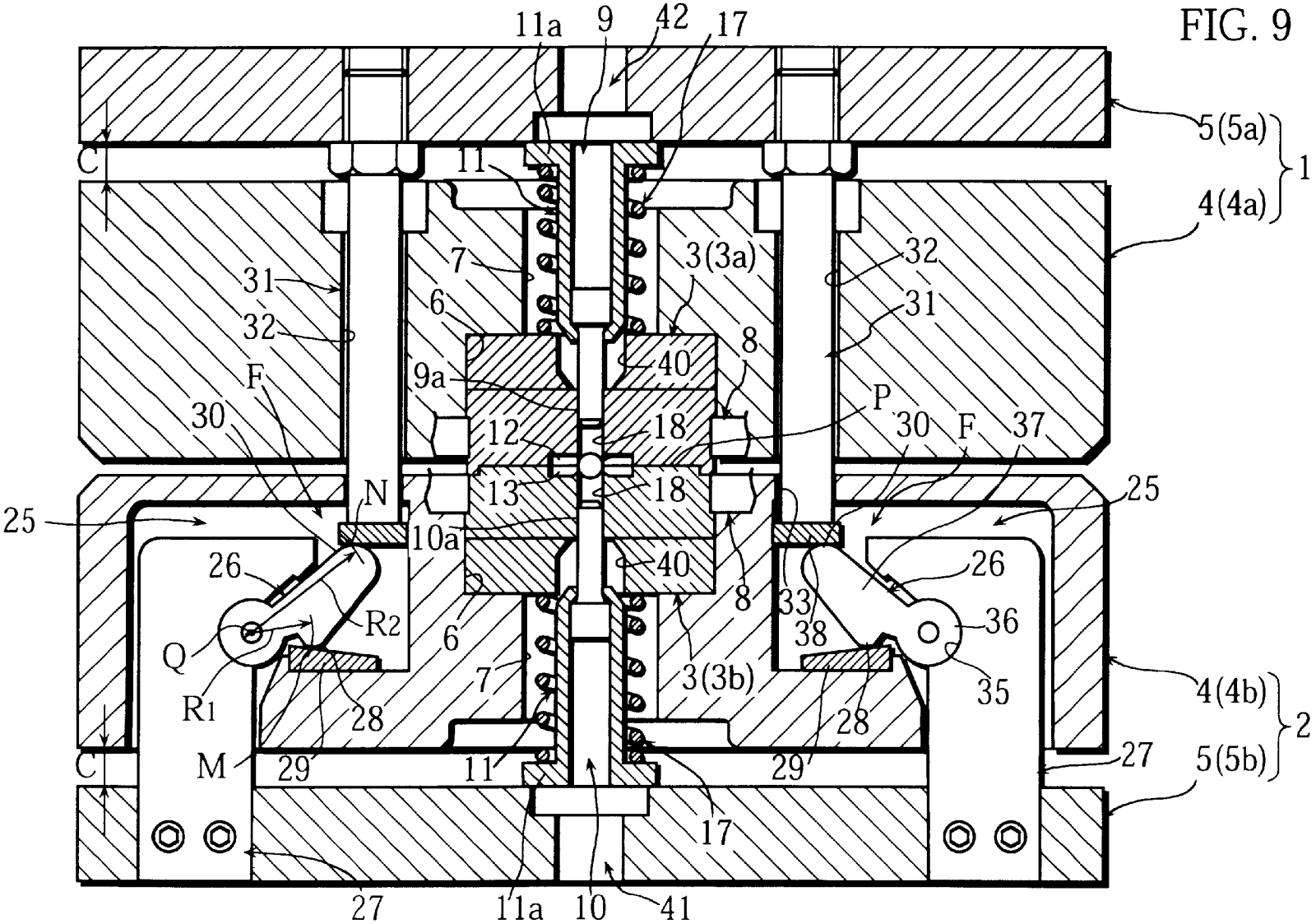
FIG. 9 is a cross-sectional front view showing a fourth preferred embodiment of the present invention.
Figure 10:
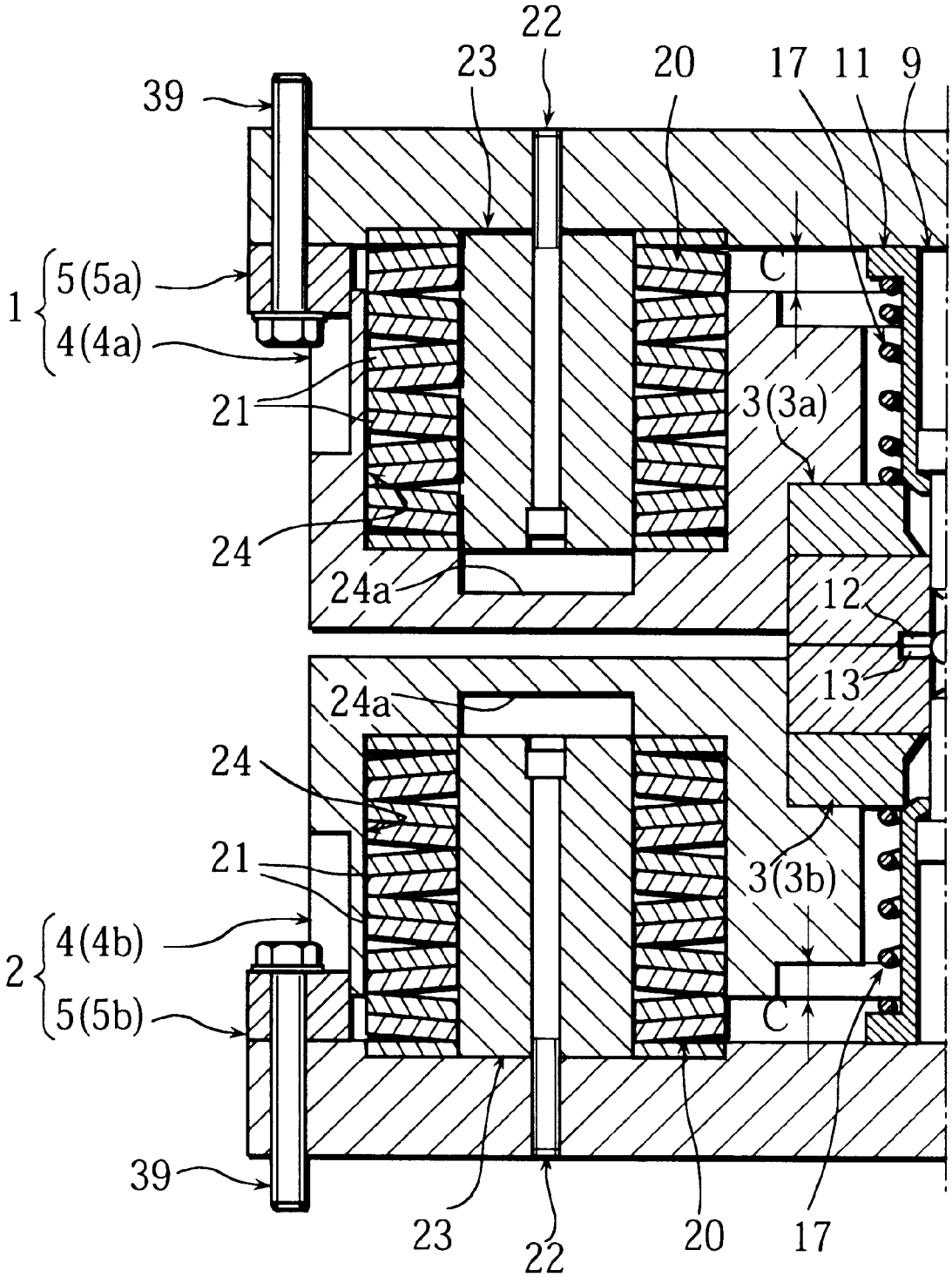
FIG. 10 is a left-half cross-sectional view showing spring mechanisms.
Figure 11:
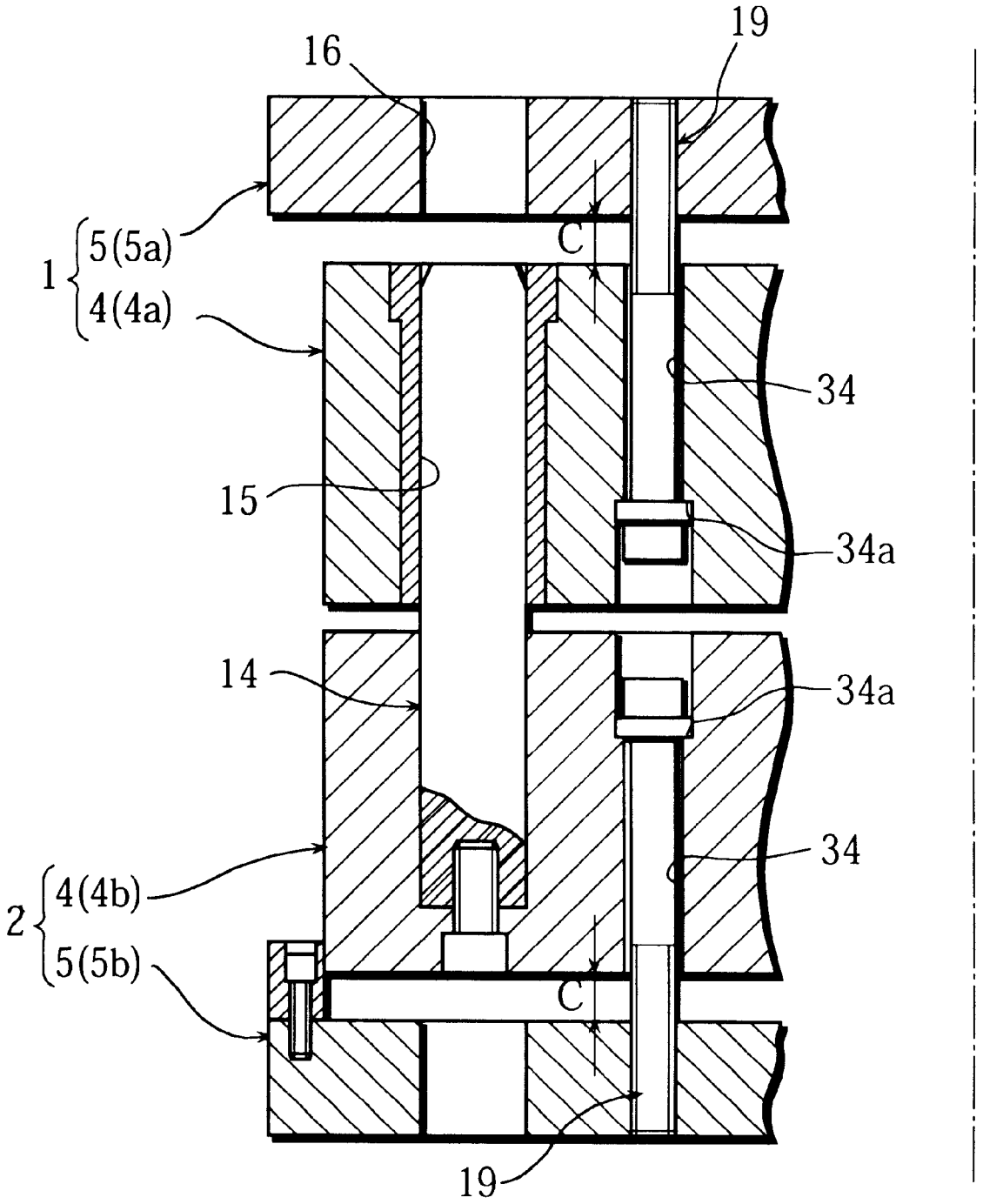
FIG. 11 is a cross-sectional view of a principal portion showing a guiding rod which adjusts positions of the upper die holder and the lower die holder.

Next, FIG. 9 through FIG. 11 show another embodiment of the full enclosed forging apparatus of the present invention. This full enclosed forging apparatus is provided with an upper die holder 1 and a lower die holder 2 disposed in a press machine as to face each other. The upper die holder 1 and the lower die holder 2 are respectively composed of a holder main body 4 holder a die 3, and a holder base 5 attached to the press machine. Concretely, an upper holder base 5*a* is directly attached to an upper attachment stage or a ram of the press machine, and a lower holder base 5*b* is directly attached to a lower attachment stage of the press machine. 39 is a bolt with which the upper holder base 5*a* and the lower holder base 5*b* are attached to the press machine.

And, hole portions are formed on a central portion of an upper holder main body 4*a*. That is to say, a large hole portion 6 for inserting an upper die 3*a* and a small hole portion 7 communicating with the large hole portion 6 are formed on a lower face side of the upper holder main body 4*a*. The upper die 3*a* is inserted to the large hole portion 6 and fixed with a holding member 8 fixed to the lower face side of the upper holder main body 4*a*. And, in the lower die holder 2, similar to the upper die holder 1, a large hole portion 6 and a small hole portion 7 for inserting a lower die 3*b* are formed on an upper face side of a lower holder main body 4*b*, and the lower die 3*b* is inserted to the large hole portion 6 and fixed with a holding member 8.

And, an upper punch 9 is disposed on a lower side of the upper holder base 5*a* and a lower punch 10 is disposed on an upper side of the lower holder base 5*b*, and the upper and lower punches 9 and 10 are held by upper and lower cylindrical holding bodies 11 each of which is attached to the upper and the lower holder bases 5*a* and 5*b*. The upper cylindrical holding body 11 is attached to a punch knock pin 42 protrudable downward from a lower face of the upper holder base 5*a*, and the lower cylindrical holding body 11 is attached to a die knock pin 41 protrudable upward from an upper face of the lower holder base 5*b*. Further, an elastic member 17 is respectively disposed between an outer brim portion 11*a* of the upper cylindrical holding body 11 and the upper die 3*a*, and between an outer brim portion 11*a* of the lower cylindrical holding body 11 and the lower die 3*b*, and the upper punch 9 and the lower punch 10 are respectively pushed upward and downward through the cylindrical holding bodies 11. And, the upper punch 9 is inserted to a central hole portion 18 of the upper die 3*a*, and the lower punch 10 is inserted to a central hole portion 18 of the lower die 3*b*. A holding body insertion hole 40 which communicates with each of the central hole portions 18 is formed on an upper face side of the upper die 3*a* and a lower face side of the lower die 3*b* respectively, and cross-shaped forming die portions 12 and 13 which communicate with the central hole portions 18 are formed on a lower face side of the upper die 3*a* and an upper face side of the lower die 3*b* respectively.

As shown in FIG. 11, a pair of guiding rods 14 (one of which is shown in FIG. 11) protrude upward from the lower holder main body 4*b* of the lower die holder 2 as to be symmetric with respect to the die 3, insertion holes 15 for inserting the guiding rod 14 are formed in the upper holder main body 4*a*, and insertion holes 16 for inserting the guiding rod 14 are formed in the upper holder base 5*a* of the upper die holder 1. That is to say, in working of the press machine, position adjustment of the upper die holder 1 and the lower die holder 2 is conducted by inserting the guiding rods 14 to the insertion holes 15, and the upper die 3*a* and the lower die 3*b* are accurately closed thereby.

Figure 12:
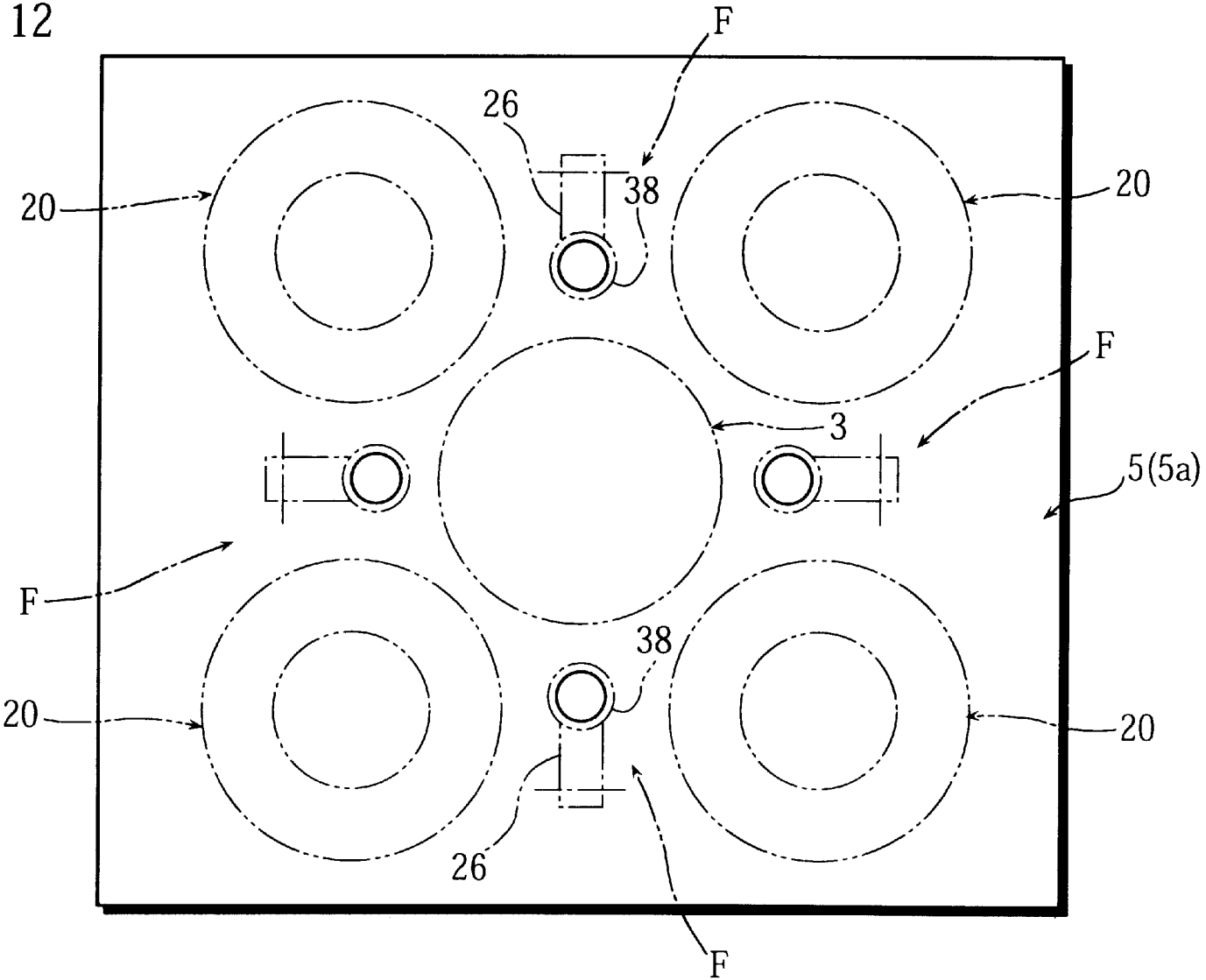
FIG. 12 is an explanatory view showing positional relationship of a punch uniform movement mechanism and the spring mechanisms.

And, as shown in FIG. 10 through FIG. 12, the upper holder main body 4*a* is attached to the upper holder base 5*a* through plural units of spring mechanisms 20 retaining an aperture C for contraction of the spring mechanisms 20, and the lower holder main body 4*b* is attached to the lower holder base 5*b* through plural spring mechanisms 20 with an aperture C for contraction of the spring mechanisms 20.

To describe the attachment construction concretely, the upper holder main body 4*a* is attached to the upper holder base 5*a* through bolts 19 with the above aperture C with which the upper holder main body 4*a* can vertically move for a predetermined distance to the upper holder base 5*a*, and the lower holder main body 4*b* is attached to the lower holder base 5*b* with the aperture C with which the lower holder main body 4*b* can vertically move for a predetermined distance to the lower holder base 5*b*. And, a head portion of the bolt 19 restricts the movement of the holder main body 4 not to part from the holder base 5 for over the aperture C by hitching (through a washer, etc.) on a staged portion 34*a* of a bolt insertion hole 34 formed on the holder main body 4.

Further, in the upper die holder 1, the above-described spring mechanism 20 is composed of concentrically laminated plural belleville springs 21 fitted to a belleville spring holding body 23 fixed to the upper holder base 5*a* with a bolt 22, placed in a spring mechanism insertion hole 24 formed in the upper holder main body 4*a*, and elastically pushing the upper holder main body 4*a* downward to the upper holder base 5*a*. A concave portion 24*a*, for escapement of the belleville spring holding body 23 in closing the die, is formed on a bottom portion of an insertion hole 24. On the other hand, in the lower die holder 2, the spring mechanism 20 is composed of concentrically laminated plural belleville springs 21 fitted to a spring holding body 23 fixed to the lower holder base 5*b* with a bolt 22, placed in a spring mechanism insertion hole 24 formed in the lower holder main body 4*b*, and elastically pushing the lower holder main body 4*b* upward to the lower holder base 5*b*. In this case, elastic force of the spring mechanism 20 of the lower die holder 2 side is set to be larger than that of the spring mechanism 20 of the upper die holder 1 side for 5% to 30% (preferably 8% to 20%).

The plural spring mechanisms 20 are disposed to be symmetric with respect to the die 3, each of the upper die holder 1 and the lower die holder 2 is provided with four units of the spring mechanism 20 in the present embodiment.

According to the construction described above, the upper punch 9 and the lower punch 10 can proceed into the die 3 after the contact of the upper die 3*a* and the lower die 3*b* held by the upper die holder 1 and the lower die holder 2 (described later in detail). Further, the full enclosed forging apparatus of the present invention is provided with a punch uniform movement mechanism F, equivalent to the synchronization mechanism G described in the second preferred embodiment, which moves a lower end 9*a* of the upper punch 9 and an upper end 10*a* of the lower punch 10 toward a mating face position P of the upper and lower die 3*a* and 3*b* at an equal velocity.

As shown in FIG. 9, the punch uniform movement mechanism F is provided with a cam 26 disposed in a vacant chamber 25 formed in the lower holder main body 4*b* of the lower die holder 2, a cam holding member 27, of which lower end is attached to the lower holder base 5*b* and upper end is inserted to the vacant chamber 25, holding the cam 26 as to freely rotate, a sliding member 29 fixed to the vacant chamber 25 as to contact a first sliding portion 28 of the cam 26, and a push rod 31, of which upper end is attached to the upper holder base 5*a* of the upper die holder 1 and lower end is inserted to the vacant chamber 25 penetrating the upper holder main body 4*a*, contacts a second sliding portion 30 of the cam 26.

To describe in further detail, an insertion hole 32, to which the push rod 31 is inserted, is formed in the upper holder main body 4*a*, a through hole 33 communicating with the vacant chamber 25 is formed on an upper face of the lower holder main body 4*b*, and a lower end of the push rod 31 is inserted into the vacant chamber 25 through the above insertion hole 32 and the through hole 33.

And, the cam 26 is composed of a cylindrical portion 36 fitted to an arc groove 35 formed on an upper part of the cam holding member 27, and an oscillating piece 37 provided with a first sliding portion 28 having an arc portion and a second sliding portion 30 having an arc portion. The oscillating piece 37 oscillates up and down by rotation of the cylindrical portion 36 sliding on the arc groove 35. And, a pressing member 38, guided in vertical direction by a guiding mechanism not shown in Figures, is placed on the second sliding portion 30 of the oscillating piece 37 of the cam 26, and the lower end of the push rod 31 presses the oscillating piece 37 of the cam 26 through the pressing member 38. And, on the sliding member 29 fixed to a bottom portion of the vacant chamber 25, a sliding face which contacts the first sliding portion 28 of the cam 26 is formed to be inclined or concave.

Further, in the punch uniform movement mechanism F constructed as described above, ratio of a distance $R_1$, from a rotational center position Q of the cam 26 to a first contact position M of the first sliding portion 28 and the sliding member 29, to a distance $R_2$, from the rotational center position Q of the cam 26 to a second contact position N of the second sliding portion 30 and the push rod 31, is set to be 1:2. In this case, the pressing member 38 is regarded as a part of the push rod 31 in forging because the push rod 31 contacts the second sliding portion 30 through the pressing member 38. And, as shown in FIG. 9 and FIG. 12, plural units of the punch uniform movement mechanism F are disposed symmetrically with respect to the die 3, and a case that four units of the punch uniform movement mechanism F are disposed between the spring mechanisms 20 is shown in the present embodiment. Further, the above pressing member 38 may be formed to be a ring shared by all units of the punch uniform movement mechanism F. In this case, a circular vacant portion, in which the ring-shaped pressing member 38 can vertically move, is formed in the lower holder main body 4*b*.

Next, working of the full enclosed forging apparatus of the present invention will be described with reference to FIG. 9 through FIG. 13. First, as a preparatory stage of forging, the upper die holder 1 and the lower die holder 2 are attached to the press machine as to be vertically facing each other. In this case, the upper die 3*a* and the upper punch 9 of predetermined configurations are attached to the upper die holder 1, and the lower die 3*b* and the lower punch 10 of predetermined configurations are attached to the lower die holder 2 beforehand.

Then, material is placed in the central hole portion 18 of the lower die 3*b* while the upper die holder 1 and the lower die holder 2 are separated for a predetermined interval. After the material is placed, for example, as shown in FIG. 9, the upper die holder 1 is descended with the upper die 3*a* by working of the press machine, the upper die 3*a* attached to the upper die holder 1 contacts the lower die 3*b* attached to the lower die holder 2, and the material set on the lower die 3*b* is held by the upper die 3*a* and the lower die 3*b* as to conduct predetermined forging (first movement). And, by the first movement, the push rod 31 attached to the upper holder base 5 goes through the through hole 33 of the lower holder main body 4*b* and contacts the pressing member 38 on the cam 26 in a position of top dead point.

Next, continuing from the first movement, the upper holder main body 4*a* and the lower holder main body 4*b* are pressed through the touching upper die 3*a* and lower die 3*b* by descending the upper die holder 1 with the upper die 3*a*, the upper holder main body 4*a* relatively moves upward to the upper holder base 5*a* and the lower holder main body 4*b* relatively moves downward to the lower holder base 5*b* resisting against the pushing force of the spring mechanisms 20 as to narrow the aperture C between the upper holder main body 4*a* and the upper holder base 5*a*, and the aperture C between the lower holder main body 4*b* and the lower holder base 5*b*.

According to the above working, the upper punch 9 attached to the upper die holder 1 and the lower punch 10 attached to the lower die holder 2 proceed respectively into the upper die 3*a* and the lower die 3*b*, the material held between the upper die 3*a* and the lower die 3*b* is forged into a predetermined configuration (second movement).

Figure 13:
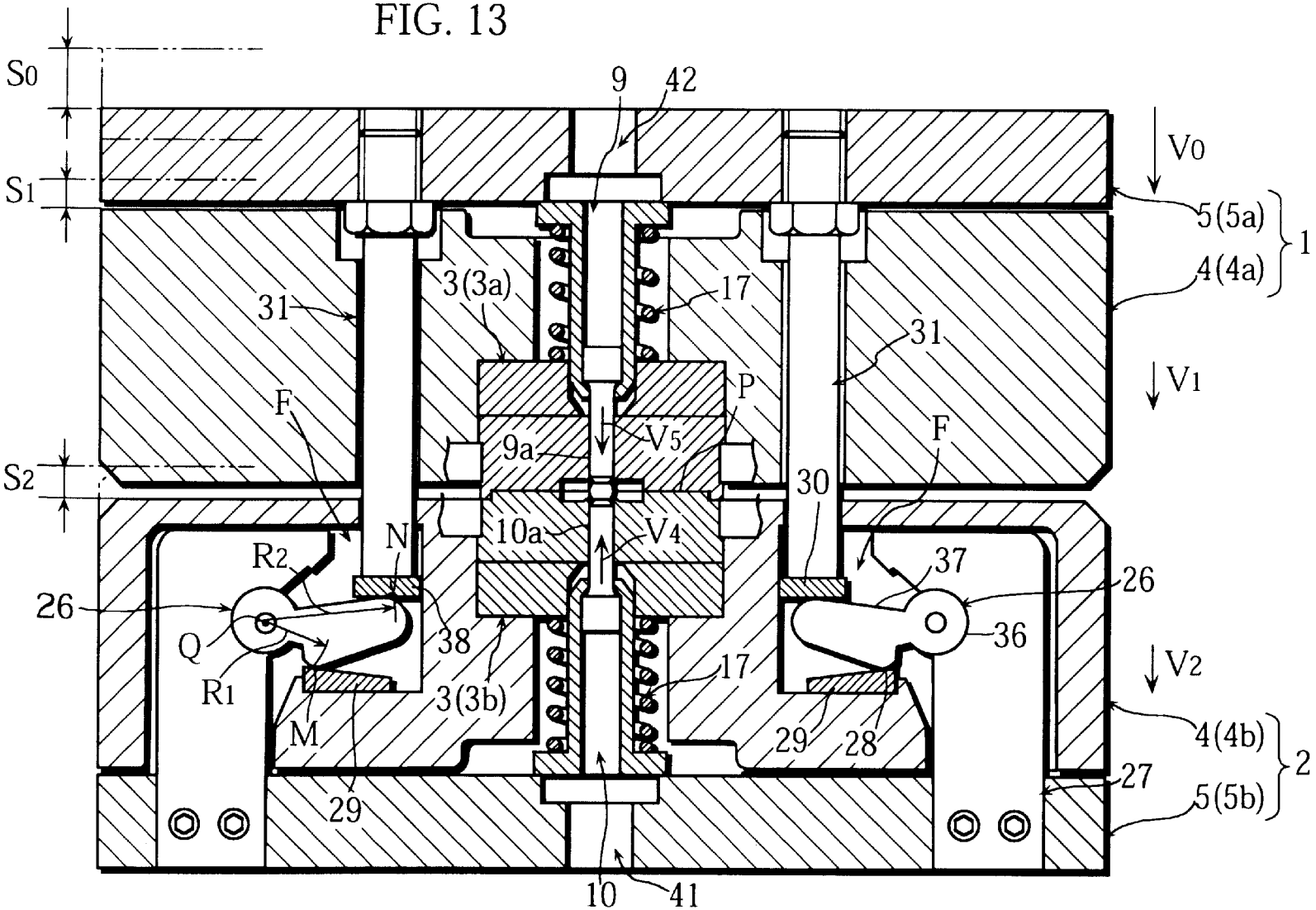
FIG. 13 is a cross-sectional front view showing full enclosed forging state.

To describe in further detail, in the second movement, as shown in FIG. 13, a lower end 9*a* of the upper punch 9 and an upper end of the lower punch 10 are moved to the contact face position P at an equal velocity by working of the punch uniform movement mechanism F, and forging is conducted thereby.

To describe the working of the punch uniform movement mechanism F, accompanying the descent of the upper holder base 5*a* (from the position shown with an imaginary line) for a predetermined descending amount $S_0$, the push rod 31 descends for the same descending amount $S_0$. By this descent, the lower end of the push rod 31 presses the oscillating piece 37 of the cam 26 through the pressing member 38 to oscillate downward to a position of bottom dead point, the sliding member 29 is pressed by the oscillating piece 37, and the lower holder main body 4*b* descends (from a position shown with an imaginary line) for a predetermined descending amount $S_2$.

In this case, the descending amount $S_0$ of the push rod 31 and the upper holder base 5*a* becomes twice as the descending amount $S_2$ of the lower holder main body 4*b* because, as described above, ratio of the distance $R_1$, from the rotational center position Q of the cam 26 to the first contact position M of the first sliding portion 28 and the sliding member 29, to the distance $R_2$, from the rotational center position Q of the cam 26 to the second contact position N of the second sliding portion 30 and the push rod 31, is set to be 1:2. That is to say, in the second movement, when the descending speed of the push rod 31 and the upper holder base 5*a* is $V_0$, and the descending speed of the lower holder main body 4*b* is $V_2$, $V_0=2\ V_2$.

On the other hand, the upper holder main body 4*a* is pressed to the lower holder main body 4*b* by the spring mechanisms 20, and the upper holder main body 4*a* descends from a position shown with an imaginary line) for a predetermined descending amount $S_1$ in a state that the upper die 3*a* and the lower die 3*b* contact each other. That is to say, the descending amount $S_1$ of the upper holder main body 4*a* is same as the descending amount $S_2$ of the lower holder main body 4*b*, and $V_1=V_2$ (the descending speed of the lower holder main body 4*b*) when the descending speed of the upper holder main body 4*a* is $V_1$.

The lower punch 10 is relatively moved to approach the mating face position P of the upper die 3*a* and lower die 3*b* by descent of the upper and lower die 3*a* and 3*b*. When the approach movement speed of the lower punch 10 is $V_4$, $V_4=V_2$. And, the upper punch 9 descends at the descending speed $V_0$ of the upper holder base 5*a* and approaches the contact face position P of the upper die 3*a* and lower die 3*b*. When approach movement speed of the upper punch 9 relatively approaching the contact face position P is $V_5$, $V_5=V_0-V_1=V_2$ because the upper die 3*a* descends at the descending speed $V_1$. That is to say, the approach speed of the upper punch 9 to the mating face position P is equal to the approach speed of the lower punch 10 to the mating face position P, and the lower end 9*a* of the upper punch 9 proceeds into the upper die 3*a* and the upper end 10*a* of the lower punch 10 proceeds into the lower die 3*b* approach the mating face position P of the upper die 3*a* and the lower die 3*b* at an equal speed.

After the forging conducted as described above, the upper die holder 1 is ascended with the upper die 3*a*, the aperture C between the upper holder base 5*a* and the upper holder main body 4*a* and the aperture C between the lower holder base 5*b* and the lower holder main body 4*b* are enlarged by pushing force of the belleville springs 21 of the spring mechanisms 20 in a state that the upper die 3*a* and the lower die 3*b* contact and hold the formed product, the upper holder main body 4*a* moves downward relatively to the upper holder base 5*a*, and the lower holder main body 4*b* moves upward relatively to the lower holder base 5*b*.

And, the upper die holder 1 is ascended further with the upper die 3*a*, the contact of the upper die 3*a* and the lower die 3*b* is released, the upper die 3*a* and the lower die 3*b* are opened, the formed product is parted form the upper die 3*a* and the lower die 3*b* by the upper punch 9 and the lower punch 10 pushed by that the punch knock pin 42 and the die knock pin 41 are respectively pressed by rods on the press machine side with a slight delay, and takeout of the product is completed thereby (the formed product can be easily taken out of the die). In this case, the upper punch 9 and the lower punch 10 are parted from the formed product and returned to initial positions by pushing force of the elastic members 17.

The cam 26 is always kept touching the sliding member 29 and the push rod 31 (the pressing member 38) in the closed state by setting the elastic force of the spring mechanism 20 of the lower die holder 2 side larger than the elastic force of the spring mechanism 20 of the upper die holder 1 side for 5 to 30%, and the approach movement speed $V_5$ of the upper punch 9 to the mating face position P of the die 3 can be surely equal to the approach movement speed $V_4$ of the lower punch 10 to the mating face position P thereby. And, when increase of the elastic force of the spring mechanism 20 of the lower die holder 2 side is smaller than 5%, the approach movement speed $V_5$ of the upper punch 9 to the mating face position P and the approach movement speed $V_4$ of the lower punch 10 to the mating face position P tend to differ each other, and, increase of over 30% is excessive because the apparatus becomes large as a whole for large belleville springs 21.

In the present invention, not restricted to the above embodiments, for example, various configurations of the cam 26 and the sliding member 29 are possible as long as ratio of the vector in vertical direction on the first contact position M of the cam 26 to the vector in vertical direction on the second contact position N of the cam 26 is always 1:2. And, the cam holding member 27 may be attached to the lower holder base 5*b* as to be adjustable in height to adjust the height of the cam 26 by adjusting the height of the cam holding member 27. And, a core bar can be disposed on the rotational center position Q of the cam 26 and attached to the cam holding member 27. And, in the fourth preferred embodiment, the spring mechanism 20 may be composed of a compression spring instead of the belleville spring 21. And, Although the upper die holder 1 and the lower die holder 2 are moved simultaneously at the same speed and for the same amount in a basic motion, only one of the upper and lower die holders 1 and 2 can be moved (single closing) by fixing one of the holder main bodies to one of the die holders without double-action (in which both of the holder main bodies are moved).

According to the full enclosed forging apparatus of the present invention, double-action forging can be conducted with a mechanism having a compact and simple construction. And, the belleville spring and the compression spring can be used for the spring mechanism. Further, necessary pressure and distance for the double-action forging can be easily set by choice of the elastic modulus of the belleville spring and the compression spring, and by changing the number of the belleville spring and the compression spring.

For these conditions, the apparatus has durability, and double-action forged product having a complicated configuration is easily and economically made even with a small single action press machine having a small die height.

And, the double action is smoothly conducted by making the pressure and distance for the double-action forging uniform, and the double-action forging is conducted with high accuracy.

And, the double action is smoothly conducted by making the pressure and distance for the double-action forging uniform with the spring mechanisms disposed symmetrically around the die, and the double-action forging is conducted with high accuracy.

And, according to the full enclosed forging apparatus of the present invention, forging can be conducted with a compact and simple construction. The forging is conducted with high accuracy because the punch uniform movement mechanism moves the upper punch and the lower punch at the same speed to the mating face position of the die to press the material in the die.

And, punch uniform movement mechanism, having a relatively simple construction, is made easily.

Further, according to the full enclosed forging apparatus of the present invention, the cam is kept touching the sliding member and the push rod in forging, and the closing speed of the upper punch and the lower punch to the mating face position are certainly made equal thereby.

Further, with the synchronization mechanism which synchronizes the descent of the lower holder main body of the lower die holder with the descent of the upper holder main body of the upper die holder, even in case that difference in forging resistance is generated between the upper die and the lower die, the upper and lower die holders are forced to move synchronously, the forging is conducted uniformly, and accuracy of the forged product is kept high.

And, when the forged product release mechanism which forcibly releases the forged product in the upper die is disposed in the upper holder base, the forged product in the upper die is released certainly and forcibly, and automatic forging is conducted smoothly.

While preferred embodiments of the present invention have been described in this specification, it is to be understood that the invention is illustrative and not restrictive, because various changes are possible within the spirit and indispensable features.

What is claimed is:

1. A fully enclosed forging apparatus comprising:

a construction in which an upper die holder and a lower die holder are respectively disposed so as to face each other in a press machine, the upper die holder being composed of an upper holder main body holding an upper die and an upper holder base attached to the press machine, the lower die holder being composed of a lower holder main body holding a lower die and a lower holder base attached to the press machine, the upper and lower holder main bodies respectively attached to the upper and lower holder bases through plural spring mechanisms with an aperture as an interference of the spring mechanisms such that an upper punch proceeds into the upper die and a lower punch proceeds into the lower die after the upper die held by the upper die holder and the lower die held by the lower die holder contact; and a punch uniform movement mechanism, which closes a lower end of the upper punch and an upper end of the lower punch to approach a mating face position of the upper and lower die, with an approach speed of the upper punch toward the mating face position being equal to an approach speed of the lower punch toward the mating face position, the punch uniform movement mechanism comprising a cam disposed in a vacant chamber formed in the holder main body of the lower die holder, a cam holding member, which allows free rotation of the cam, the lower end of which is attached to the lower holder base of the lower die holder and the upper end of which is inserted into the vacant chamber, a sliding member fixed in the vacant chamber so as to contact a first sliding portion of the cam, and a push rod, the upper end of which is attached to the upper holder base of the upper die holder and the lower end of which is inserted into the vacant chamber through the holder main body and touching a second sliding portion of the cam, and a ratio of, a distance from a rotational center position of the cam to a first contact position of the first sliding portion and the sliding member, to, a distance from the rotational center position of the cam to a second contact position of the second sliding portion and the push rod, being set to be 1:2.

2. The fully enclosed forging apparatus as set forth in claim 1, wherein elastic force of the spring mechanisms on the lower die holder side is set to be larger than elastic force of the spring mechanisms on the upper die holder side by 5 to 30%.

3. The fully enclosed forging apparatus as set forth in claim 1, wherein each of the spring mechanisms is composed of plural belleville springs concentrically laminated by insertion into a belleville spring holding body.

* * * * *